United States Patent [19]

Ackley et al.

[11] 3,942,416

[45] Mar. 9, 1976

[54] SQUARE BOTTOMED BAG FOLDING APPARATUS

[75] Inventors: Kenneth E. Ackley, Pittsford, N.Y.; William H. Eburn, Jr., Appleton, Wis.; Paul A. Lucas, Webster, N.Y.

[73] Assignee: Mobil Oil Corporation, New York, N.Y.

[22] Filed: Mar. 8, 1974

[21] Appl. No.: 449,585

[52] U.S. Cl. ..... 93/32; 93/8 R; 93/84 TW

[51] Int. Cl.[2] ..... B31B 1/32

[58] Field of Search ..... 93/32, 35 SB, 8 R, 15, 93/16, 17, 22, 23, 24, 28, 29, 30, 84 TW, 84 R

[56] References Cited

UNITED STATES PATENTS

| | | | |
|---|---|---|---|
| 830,259 | 9/1906 | Stanley | 93/32 X |
| 3,313,216 | 4/1967 | Piazze | 93/8 R |
| 3,379,101 | 4/1968 | Piazze | 93/35 SB X |
| 3,479,930 | 11/1969 | Peppler | 93/8 R |

*Primary Examiner*—Roy Lake
*Assistant Examiner*—James F. Coan
*Attorney, Agent, or Firm*—Charles A. Huggett; Michael G. Gilman; Charles A. Malone

[57] ABSTRACT

An apparatus for refolding a tapered, transversely sealed, gussetted bag into a gussetted square bottom bag, comprising: opening means whereby the wall portions are formed into distinct walls having a generally rectangular configuration; a rotating main drive assembly; an expandable rectangularly shaped member mounted to said rotating assembly; gripping means mounted to said rotating assembly for pulling said bag, open end first, around said rectangularly shaped member; means for expanding said member as said bag is pulled around said member thereby forming a rectangularly shaped bag bottom; means for gussetting said side walls toward each other in a plane generally parallel to said seal; and means for gusseting said rectangularly shaped bag bottom in a plane generally perpendicular to said seal.

2 Claims, 21 Drawing Figures

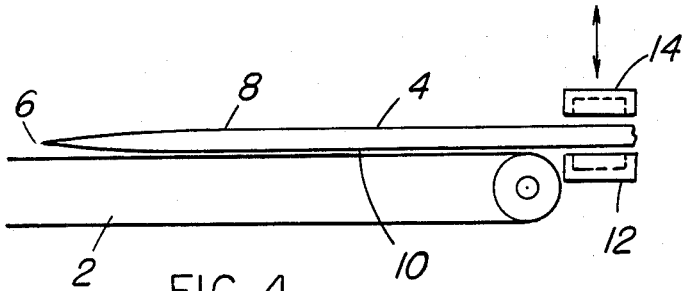
FIG. 4
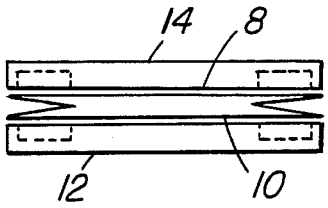
FIG. 4A
FIG. 5A
FIG. 5
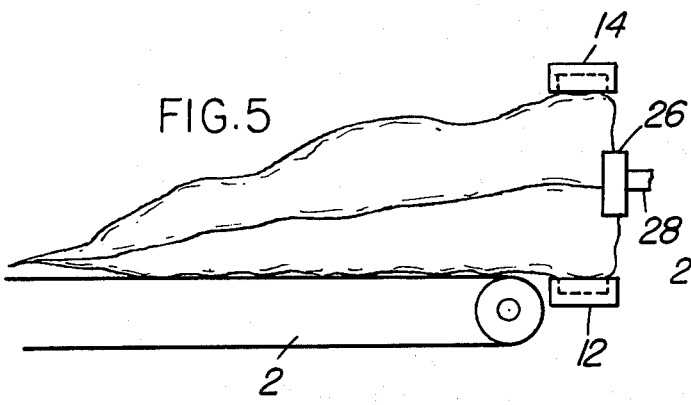
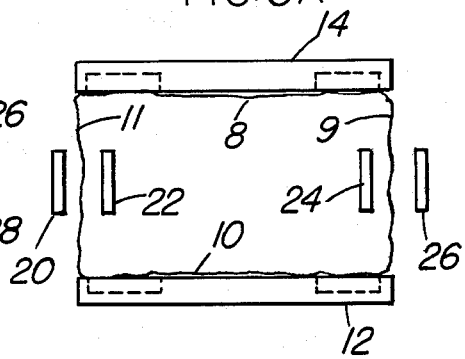
FIG. 6A
FIG. 6
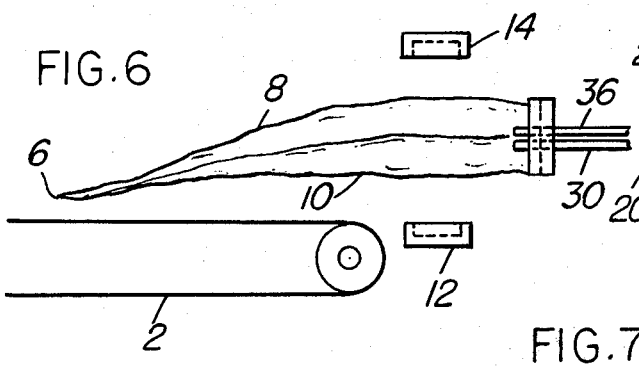
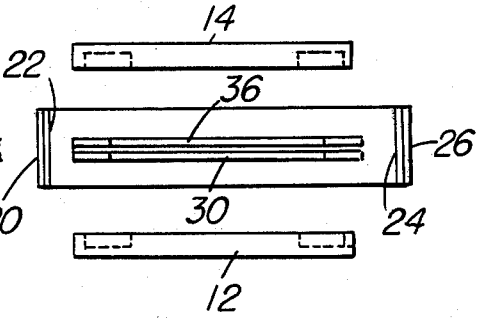
FIG. 7
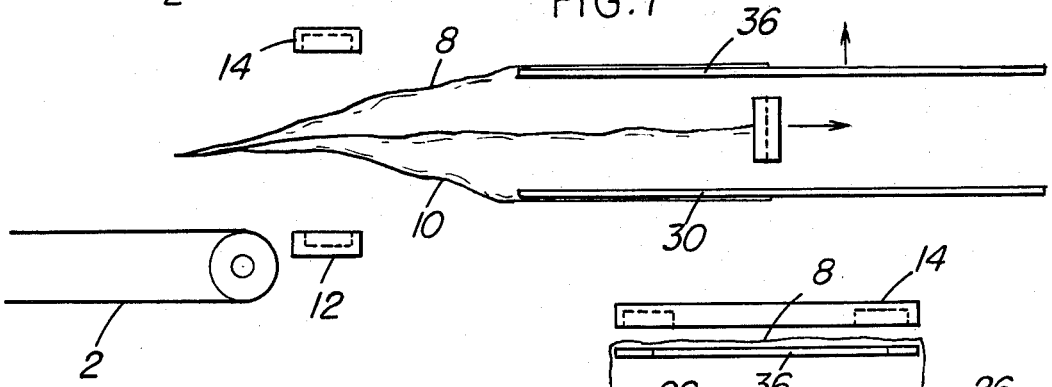
FIG. 7A
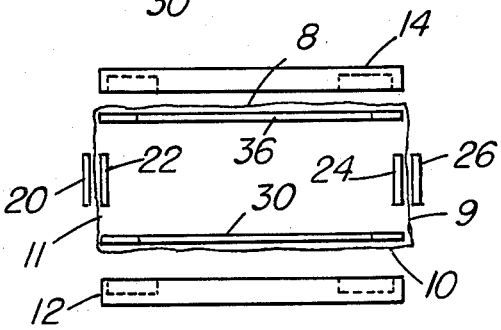

FIG. 8
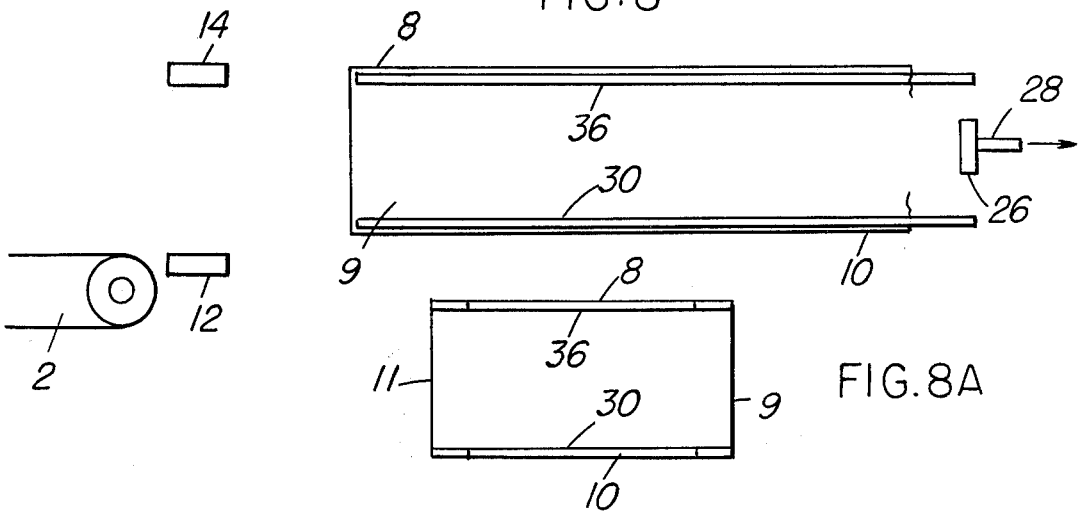
FIG. 8A
FIG. 9
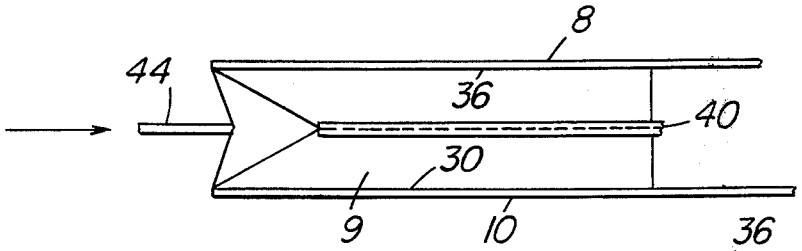
FIG. 9A
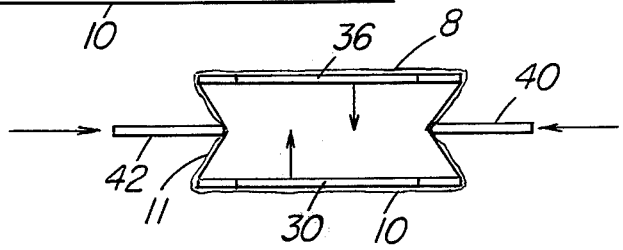
FIG. 10
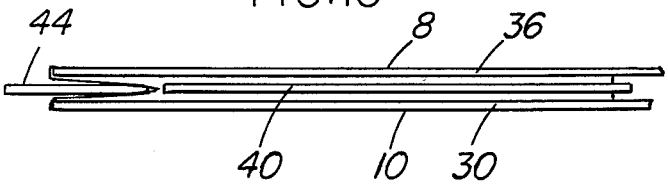
FIG. 10A
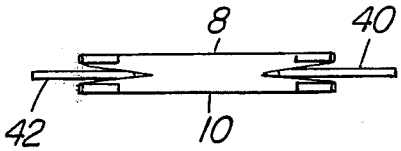
FIG. 11
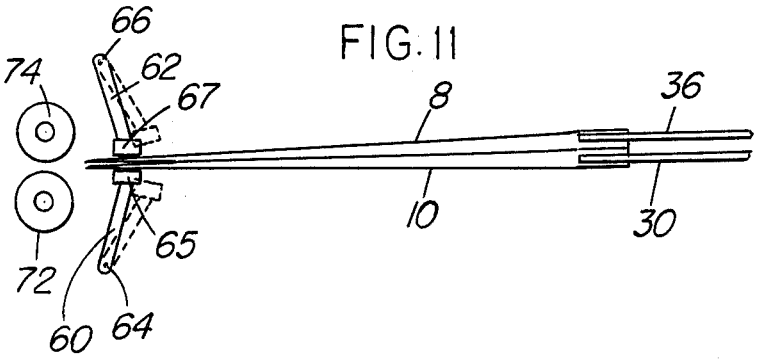
FIG. 11A
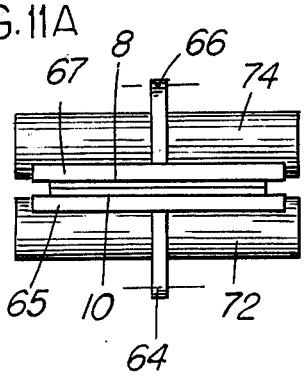

NOTE (1) Tucker Linkage and Ejector Gripper
(2) Ø is Start of Constant Velocity

SQUARE BOTTOMED BAG FOLDING APPARATUS

BACKGROUND OF THE INVENTION

1. Field of the Invention

This invention concerns the refolding of a tapered, transversely sealed gussetted bag into a bag having side pleats and a rectangularly shaped bottom.

2. Description of the Prior Art

Thermoplastic material may easily be formed into bags having a tapered or pinched bottom and gussetted side walls. According to such a process, a cylindrical thermoplastic film is expelled from an extrusion die. This cylindrical film may then be gussetted and collapsed flat. The film is then sealed perpendicularly to the edges of the sides thus forming the bottom of the bag. This seal is typically a single seam, usually produced by heating the thermoplastic material at the seam to a temperature which will fuse the two sides of the bag. As there is but a single relatively narrow seam at the bag bottom, the sides gradually taper to the sealed bottom forming a V. The thermoplastic material is then severed, again perpendicularly to the edges of the sides, in order to form a bag top. As the bags thus made are formed from long sheets of plastic, the point of severing, producing the top of one bag, is just below the bottom seam of the next adjacent bag.

While tapered bottom bags made according to the previously described method or a similar method are suitable for many purposes, they have an inherent disadvantage in that they cannot be stood upright as can a square or rectangularly bottomed bag. Grocery bags, such as those used in supermarkets, are preferentially designed with a square or rectangular bottom upon which they may be stood upright, the vertical side panels being in an upright position for easy filling.

The majority of such grocery bags presently in use fulfull this self standing requirement, and are made of paper. Such paper bags have the distinct disadvantage of generally low strength, and have a particularly low "wet strength," that is, an extremely low tensile force resistance capability upon becoming wetted, even if only locally. Coating paper bags with water-repellent or water-proof materials, such as plastics, is excessively expensive.

Paper bags have the additional disadvantage that paper sheets must be secured together at fold lines with a separately applied adhesive. Some types of adhesive used, as well as the bags themselves, attract vermin which are imported into the homes of the purchasing customer, frequently concealed between folds of the paper bag.

Bags made of plastic material have the outstanding advantage of being waterproof, verminproof, resistant to penetration of grease, oils or the like, and sufficiently flexible to follow contours of articles packed within the bag to prevent tearing, for example by corners of square boxes, cans or the like. In spite of these advantages, however, plastic grocery bags have not found substantial acceptance due to their inability to remain open, and erected, for ease of packing without any additional external support devices.

It is an objective of this invention to provide a means for refolding a gussetted, tapered bag so as to produce a bag having a square or rectangular shaped bottom which is capable of standing upright.

Other and additional objectives of this invention will be apparent in light of the entire specification and claims.

SUMMARY OF THE INVENTION

An apparatus for refolding a tapered, transversely sealed, gussetted and tapered bottom bag into a gussetted square bottom bag, said tapered bottomed bag having front and back wall portions generally parallel to said seal, gussetted side wall portions generally transverse to said seal and an open end disposed at the end of said bag opposite said seal, said apparatus comprising: opening means whereby said wall portions are formed into distinct walls having a generally rectangular configuration; a rotating main drive assembly; an expandable rectangularly shaped member mounted to said rotating assembly; gripping means mounted to said rotating assembly for pulling said bag, open end first, around said rectangularly shaped member; means for expanding said member as said bag is pulled around said member thereby forming a rectangularly shaped bag bottom; means for gussetting said side walls toward each other in a plane generally parallel to said seal; and means for gussetting said rectangularly shaped bag bottom in a plane generally perpendicular to said seal.

In a preferred embodiment the tapered bottomed bag is made of thermoplastic material such as a thin foldable film.

BRIEF DESCRIPTION OF THE DRAWINGS

FIGS. 4 – 11 illustrate the sequential operation of an apparatus adapted in accordance with this invention; FIGS. 4 – 11 are side view and FIGS. 4A – 11A are end views.

DESCRIPTION OF SPECIFIC EMBODIMENTS

Figure 1:
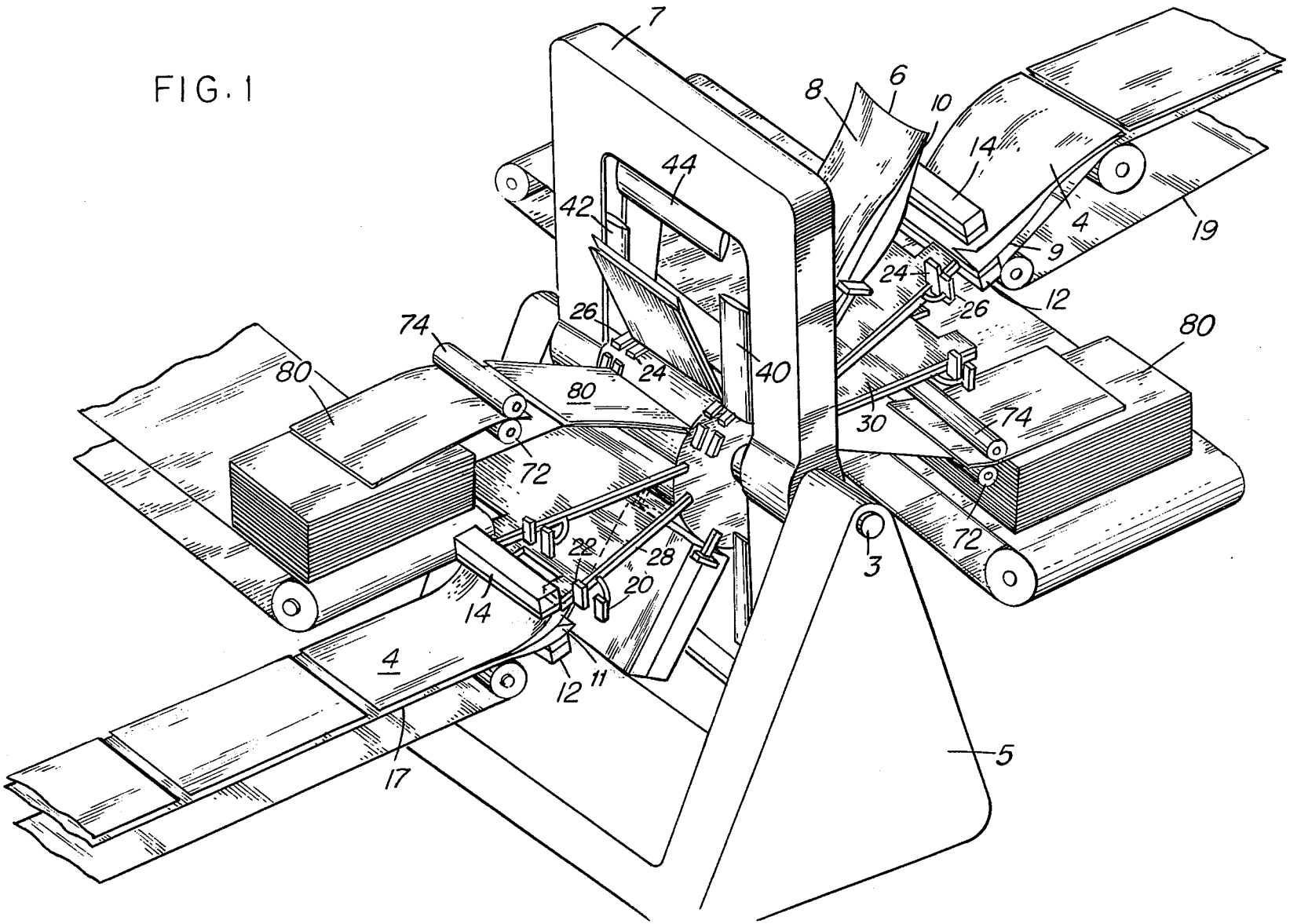
FIG. 1 is an apparatus adopted in accordance with this invention.

Referring first to FIG. 1, a tapered V bottomed bag 4, having a top side 8, a bottom side 10 and a tapered V bottom 6, may be fed by moving belt feeding means 17 and 19 into a bag folding apparatus 5. Upper vacuum means 14 and lower vaccum means 12 open the top of V bottomed bag 4, thus forming a front wall 8, a back wall 10 and two side walls 9 and 11.

Gripping means 20 and 22 may be extended from a rotating drive assembly (not shown), the assembly rotating a shaft 3, by means of a support member 28, and grip the side wall 9. Gripping means 20 and 22 may then grip the side wall 11. Gripping means 24 and 26 correspondingly may grip both sides of the side wall 9. Gripping means 20 and 22 and 24 and 26 then diverge so as to form a bag top shape wider than the finished bag top, this allowing the bag top to be pulled into position over the "duckbill" plates 30 and 36 with little or no interference around the circumference of the opened top. This widening of the bag top is accomplished by making the gripping means 20, 22, 24 and 26 narrower than the finished bag top (See FIGS. 5, 5A, 6A, 7 and 7A).

The gripping means 20 and 22 and 24 and 26 may pull the V bottomed bag 4 over expandable rectangularly shaped "duckbill" plates 30 and 36 which may also be mounted on the rotating drive assembly 1. The duckbills 30 and 36 having been inserted into the opened bag 4, the duckbills 30 and 36 gradually expand while the gripping means 20, 22, 24 and 26 are pulling the bag 4 over the duckbills 30 and 36, thereby forcing the bottom 6 of the bag 4 into a rectangular shape. The gripping means 20, 22, 24 and 26 do not disengage the bag until the "duckbill" plates 30 and 36 have completely opened. It is this very important synchronism of operations which allows for a smooth, fully controlled opening of the bag 4 and results in the bag 4 being snugly pulled into position on the duckbills 30 and 36 as they are fully expanded.

The bag 4, now having a rectangular bottom, may be positioned by the rotating drive assembly adjacent to side tuckers 40 and 42 and end tucker 44, which are contained in housing 7. The side tuckers 40 and 42 and the end tucker 44 form a pleat or gusset in the sides and end of the bag 4, simultaneously the duckbills 30 and 36 are closed.

Finally, pull grippers 60 and 62 having engaging members 65 and 67 and pivoting about points 64 and 66 respectively (See FIG. 11) may remove the bag 4 from the collapsed duckbills 30 and 36. The folded rectangularly shaped bottom bag 80 may then pass through the ironing rolls 72 and 74.

The sequential operation of the apparatus shown in FIG. 1 is shown in greater detail by FIGS. 4 – 11 and FIGS. 4A – 11A which illustrate each of the steps in both a side and end view.

Figure 2:
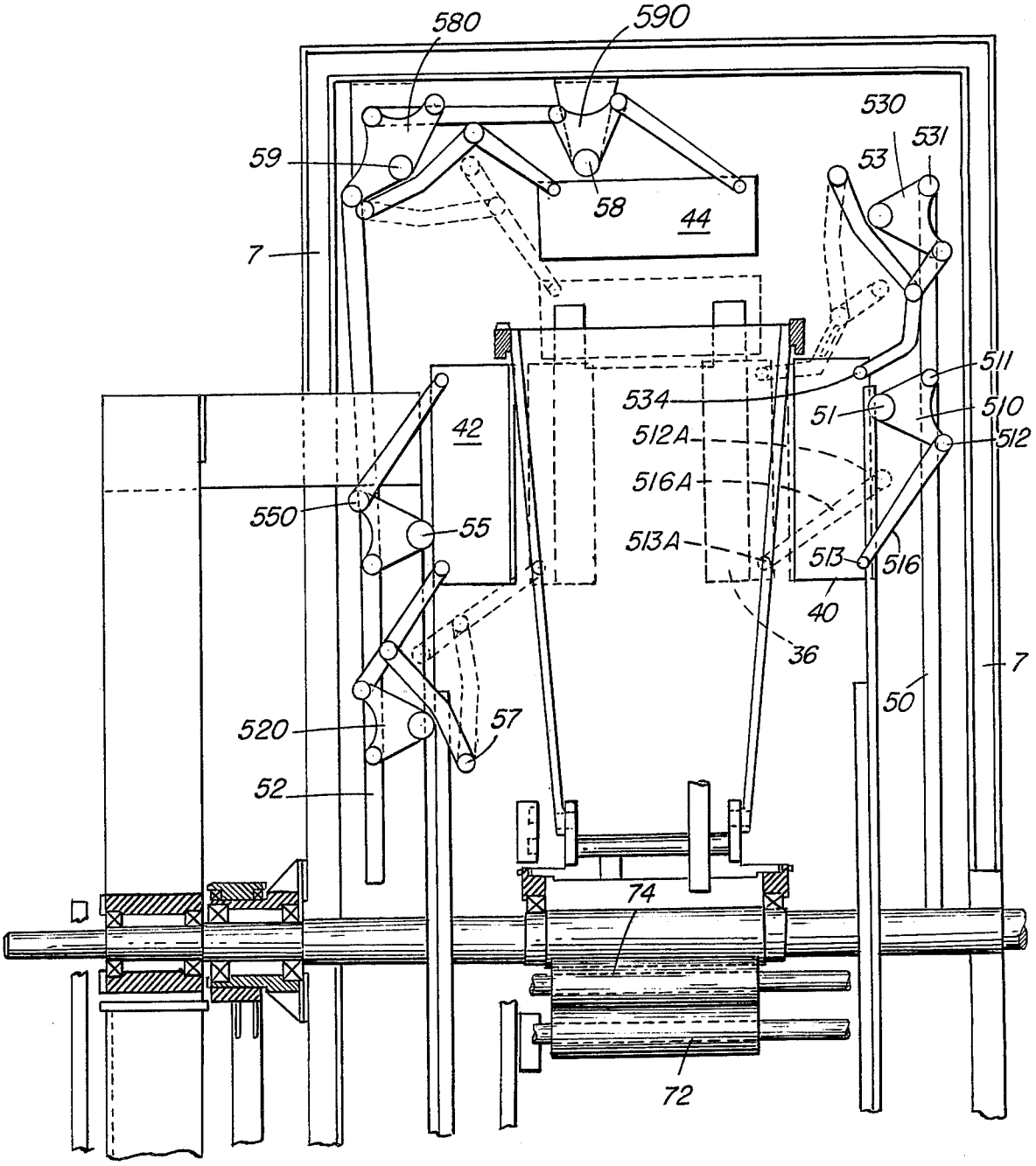
FIG. 2 is a cross-sectional view of the apparatus of this invention.

FIG. 2 is a detailed side view illustrated in detail the mechanism of the side tuckers 40 and 42 and the end tucker 44.

Reciprocating members 530 and 510 pivoting about points 53 and 51 respectively are attached to member 50 at points 531 and 511 and are attached to the side tucker 40 at points 513 and 534 respectively.

Similarly relating members 520 and 550 are attached to member 52 and side tucker 42. Finally, the end tucker 44 is operated by rotating members 590 and 580.

Illustrative of the operation of these rotating members, the mechanism of member 510 will be examined in detail. The member 510 is fixed to member 50 at point 511. As member 50 moves downward, the rotating member 510 pivots about point 51. Element 516 is moved to position 516A.

Points 512 and 513 located at either end of 516 are similarly rotated to positions indicated as 512A and 513A. As the element 516 is attached to the side tucker 40 at a point 513, the rotation of the point 513 to an inward position 513A causes the side tucker to move inward so as to form a tuck or gusset in a bag positioned adjacent to the side tucker 40.

Figures 3, 3A:
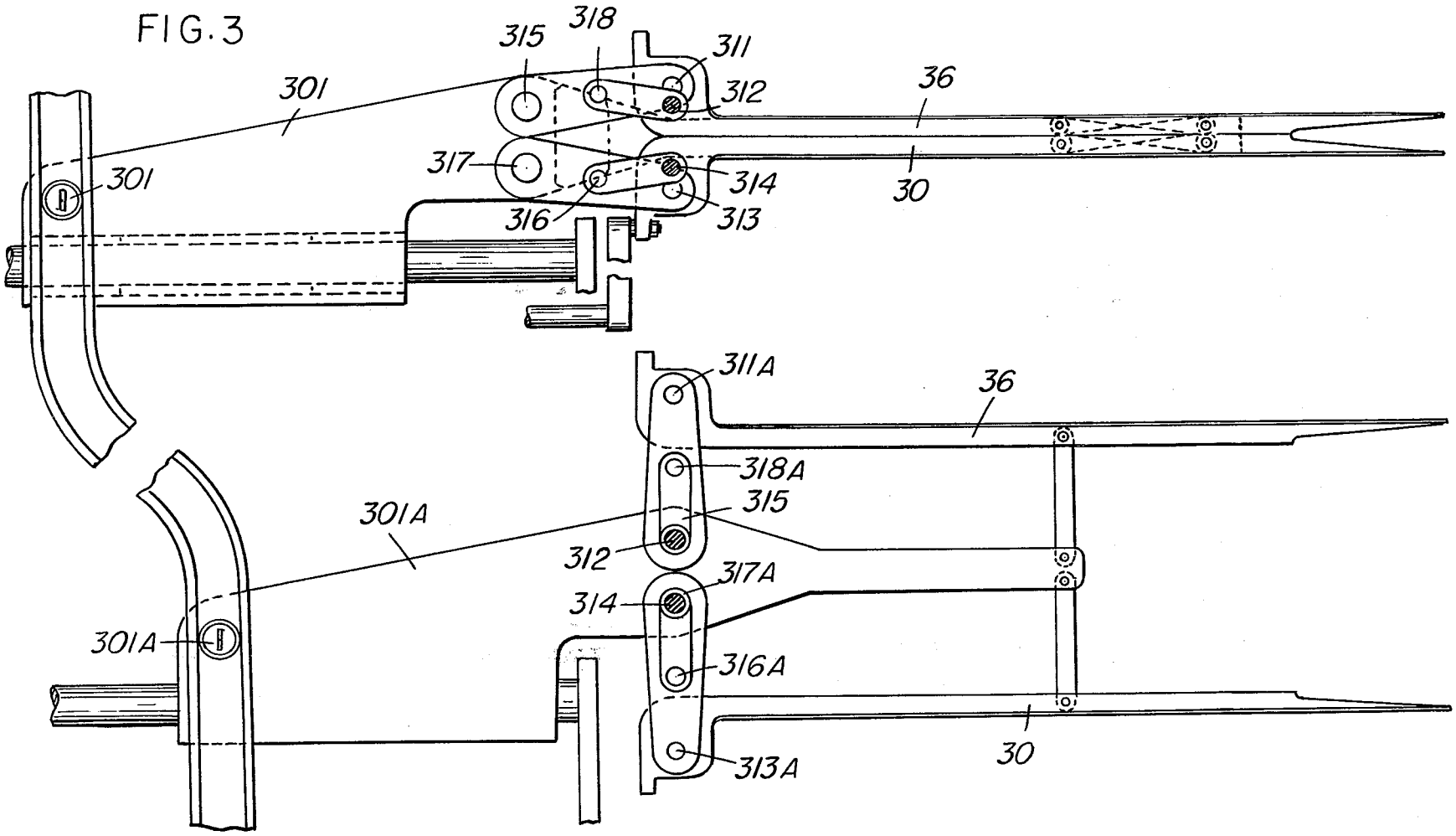
FIGS. 3 and 3A are side views of the apparatus of this invention.
Figure 12:
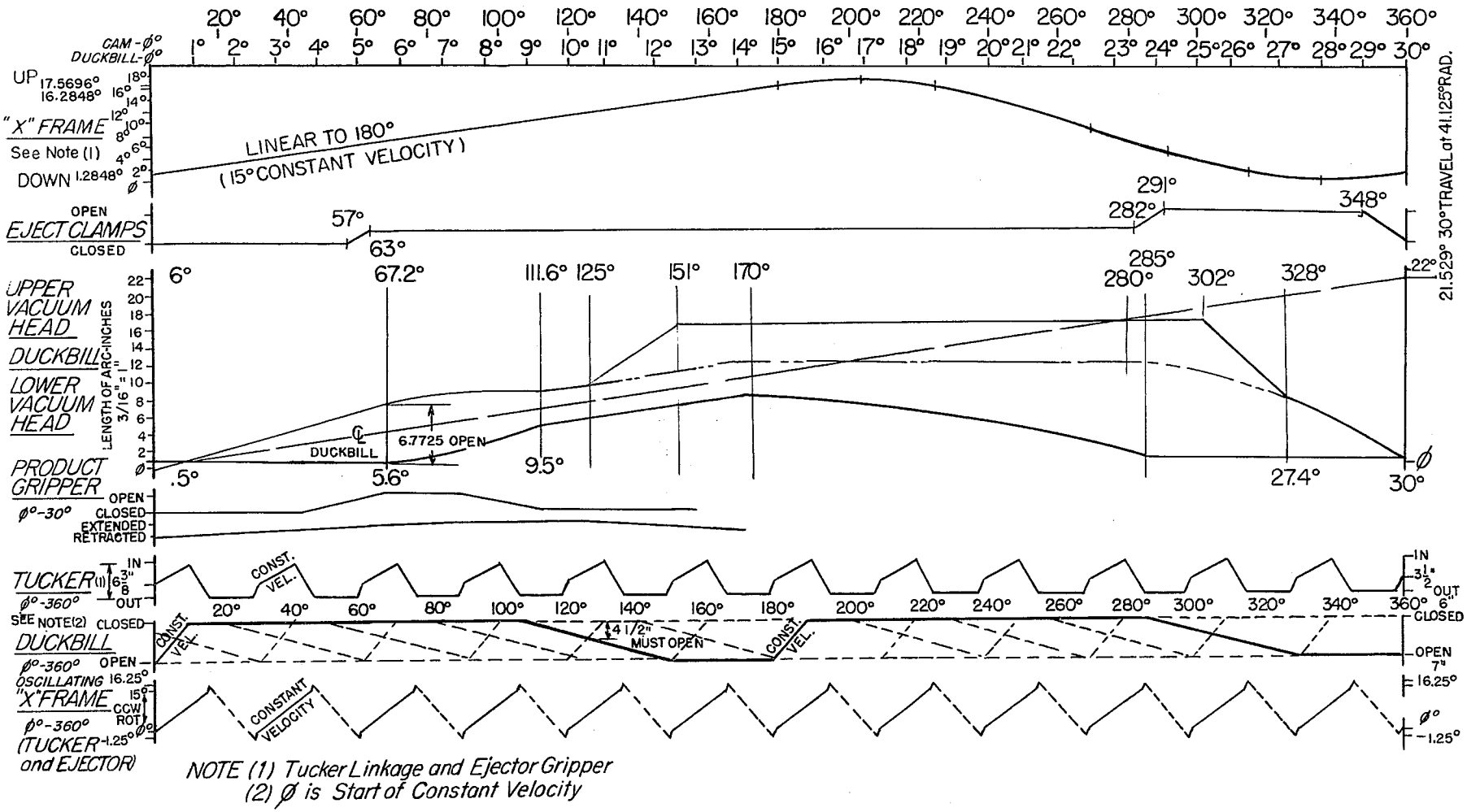
FIG. 12 is a timing chart representing the sequential operation of the apparatus fo this invention.

FIGS. 3 – 3A illustrate in detail the operation of the expansion of the duckbills 30 and 36. FIGS. 3 and 3A illustrate the opening of the duckbills when viewed from the side. Points 312 and 314 are stationary. Points 313 and 311 move outward in a straight line linkage to points 313A and 311A as the member 301 moves to a position 301A as required by the connection of point 301 (301A in FIG. 3A) to the actuating track 300.

What is claimed is:

1. An apparatus for refolding a tapered, transversely sealed, gussetted plastic film bag into a gussetted square bottom plastic film bag, said tapered bag having front and back wall portions generally parallel to said seal, gussetted side wall portions generally transverse to said seal and an open end disposed at the end of said bag opposite said seal, said apparatus comprising:

a. a shaft;

b. an expandable rectangularly shaped member mounted for rotation about said shaft;

c. means for opening plastic film bags for delivery to said expandable member;

d. feeding means for supplying said bags onto said expandable rectangularly shaped member;

e. means for expanding the rectangularly shaped member after said bag is placed thereon, thereby forming a rectangularly shaped bag;

f. means for gussetting said side wall portions toward each other in a plane generally parallel to said seal; and g. an end tucking means utilized to form a gusset across said rectangularly shaped bag bottom and generally parallel to said seal and toward said open end.

2. The apparatus as claimed in claim 1 wherein a feeding means and a removing means are each positioned at two separate locations approximately 180° apart when measuring from the axes about which said expandable member rotates.

* * * * *